US009580850B2

(12) United States Patent
Jeong

(10) Patent No.: US 9,580,850 B2
(45) Date of Patent: Feb. 28, 2017

(54) LOWER THREAD BOBBIN FOR SEWING MACHINE

(71) Applicant: SINJINSTEEL CO., LTD., Ansan-si, Gyeonggi-do (KR)

(72) Inventor: Jong Cheol Jeong, Iksan-si (KR)

(73) Assignee: SINJINSTEEL CO., LTD., Gyeonggi-do (KR)

( * ) Notice: Subject to any disclaimer, the term of this patent is extended or adjusted under 35 U.S.C. 154(b) by 245 days.

(21) Appl. No.: 14/370,890

(22) PCT Filed: Nov. 7, 2012

(86) PCT No.: PCT/KR2012/009296
§ 371 (c)(1),
(2) Date: Jul. 7, 2014

(87) PCT Pub. No.: WO2013/103192
PCT Pub. Date: Jul. 11, 2013

(65) Prior Publication Data

US 2015/0001333 A1 Jan. 1, 2015

(30) Foreign Application Priority Data

Jan. 6, 2012 (KR) ..... 10-2012-0002001

(51) Int. Cl.

| | |
|---|---|
| ***D05B 57/28*** | (2006.01) |
| ***B65H 75/04*** | (2006.01) |
| ***B65H 55/00*** | (2006.01) |
| ***B65H 75/16*** | (2006.01) |

(52) U.S. Cl.
CPC ..... *D05B 57/28* (2013.01); *B65H 55/00* (2013.01); *B65H 75/04* (2013.01); *B65H 75/16* (2013.01)

(58) Field of Classification Search
CPC ..... B65H 55/00; B65H 75/04; B65H 75/16; B65H 2701/535; D05B 57/12; D05B 57/22; D05B 57/24; D05B 57/26; D05B 57/28; D05B 59/00; D05B 59/02; D05B 59/04
USPC ..... 242/613–613.4; 112/302
See application file for complete search history.

(56) References Cited

U.S. PATENT DOCUMENTS

| | | | |
|---|---|---|---|
| 3,596,619 | A | 8/1971 | Winberg |
| 2003/0167990 | A1 | 9/2003 | Lee et al. |
| 2010/0107948 | A1 | 5/2010 | Totsu |

(Continued)

FOREIGN PATENT DOCUMENTS

| | | |
|---|---|---|
| JP | 2009-022360 | 2/2009 |
| KR | 20-0219042 | 4/2001 |
| KR | 20-0386005 | 6/2005 |

*Primary Examiner* — William E Dondero

(74) *Attorney, Agent, or Firm* — Hamre, Schumann, Mueller & Larson, P.C.

(57) ABSTRACT

The present invention relates to a lower thread bobbin for a sewing machine able to hold a thread, the bobbin comprising a crescent moon-shaped winding part on which a thread can be wound and a crescent moon-shaped securing part for covering the winding part on which the thread has been wound. The lower thread bobbin for a sewing machine has the advantage of being able to hold a greater amount of a lower thread than the very limited amount of a lower thread that is wound on general conventional bobbins, and so increasing the efficiency of sewing work as the user or sewing machinist does not replace the bobbin frequently.

3 Claims, 2 Drawing Sheets

(56) References Cited

U.S. PATENT DOCUMENTS

2015/0292130 A1* 10/2015 Sim ..... D05B 57/14
112/231

* cited by examiner

Prior Art

LOWER THREAD BOBBIN FOR SEWING MACHINE

TECHNICAL FIELD

The present invention relates to a lower thread bobbin for a sewing machine, and more particularly, to a lower thread bobbin for a sewing machine that is capable of holding a thread thereinto, the bobbin including a crescent moon-shaped winding part for winding the thread thereon and a crescent moon-shaped securing part for covering the winding part on which the thread has been wound.

BACKGROUND ART

A bobbin is a component of a sewing machine that holds a spool of thread on which a thread is wound thereinto, and in spinning fields, the bobbin is a spindle or cylinder on which a rough thread or twisted thread is wound, which may be made of wood or fiber.

Generally, a sewing machine is provided with an upper thread that is inserted into the eye of a needle and supplied along the needle on the top of fabric and a lower thread that is supplied from the underneath of the fabric for conducting over locking. The lower thread is wound on a separate bobbin, and the bobbin is used in the state of being embedded into a rotating bobbin case disposed on the underside of a table of the sewing machine, thus making it impossible to supply the lower thread continuously. If the lower thread is consumed up, accordingly, the bobbin should be exchanged with new one to supply the lower thread continuously, thus restarting the sewing work. On the other hand, a device has been developed to recognize the remaining amount of the lower thread and thus to inform a user of the exchange time, which undesirably increases the manufacturing cost thereof.

Further, a maximum amount or thickness of the lower thread really wound on the bobbin is set to a maximum amount of the lower thread that is wound at the close position to a position where a sewing needle is descended and does come into contact with the sewing needle during the sewing work. Accordingly, the amount of the lower thread wound on the conventional bobbin is very limited. As a result, the bobbin should be exchanged frequently with new one by a user or sewing machinist, which undesirably decreases the efficiency of the sewing work.

DISCLOSURE

Technical Problem

Accordingly, the present invention has been made in view of the above-mentioned problems occurring in the prior art, and it is an object of the present invention to provide a lower thread bobbin for a sewing machine that is capable of holding a greater amount of a lower thread than the very limited amount of a lower thread that is wound on conventional bobbins.

It is another object of the present invention to provide a lower thread bobbin for a sewing machine that is capable of increasing the efficiency of sewing work as a user or sewing machinist does not exchange the bobbin frequently.

Technical Solution

To accomplish the above-mentioned objects, according to the present invention, there is provided a lower thread bobbin for a sewing machine capable of holding a thread thereinto, the bobbin including a crescent moon-shaped winding part for winding the thread thereon and a crescent moon-shaped securing part for covering the winding part on which the thread has been wound.

According to the present invention, preferably, the winding part and the securing part are made of a metal material.

Advantageous Effects

According to the present invention, the lower thread bobbin for a sewing machine is capable of holding a greater amount of a lower thread than the very limited amount of a lower thread that is wound on general conventional bobbins, wherein for example, the thread of 50 m is wound on the conventional bobbin, but the thread of 250-350 m can be wound on the lower thread bobbin of the present invention.

Further, the lower thread bobbin for a sewing machine according to the present invention is capable of increasing the efficiency of sewing work as a user or sewing machinist does not exchange the bobbin frequently.

MODE FOR INVENTION

Hereinafter, an explanation on a lower thread bobbin for a sewing machine according to the present invention will be in detail given with reference to the attached drawing.

While the present invention will be described with reference to the particular illustrative embodiments, it is not to be restricted by the embodiments but only by the appended claims. It is to be appreciated that those skilled in the art can change or modify the embodiments without departing from the scope and spirit of the present invention.

Figure 1:
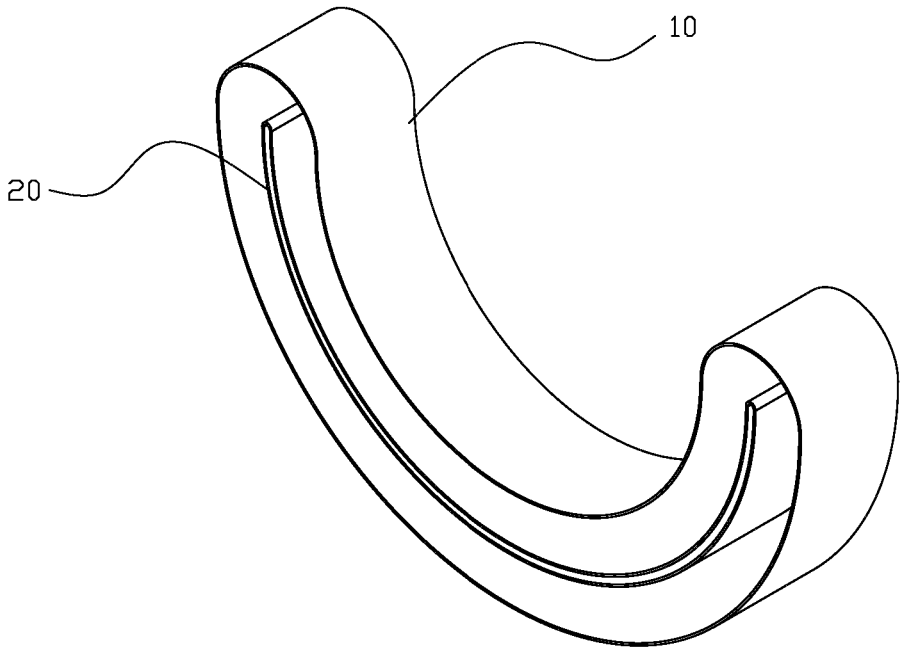
FIG. 1 is a perspective view showing a lower thread bobbin for a sewing machine according to the present invention.
Figure 2:
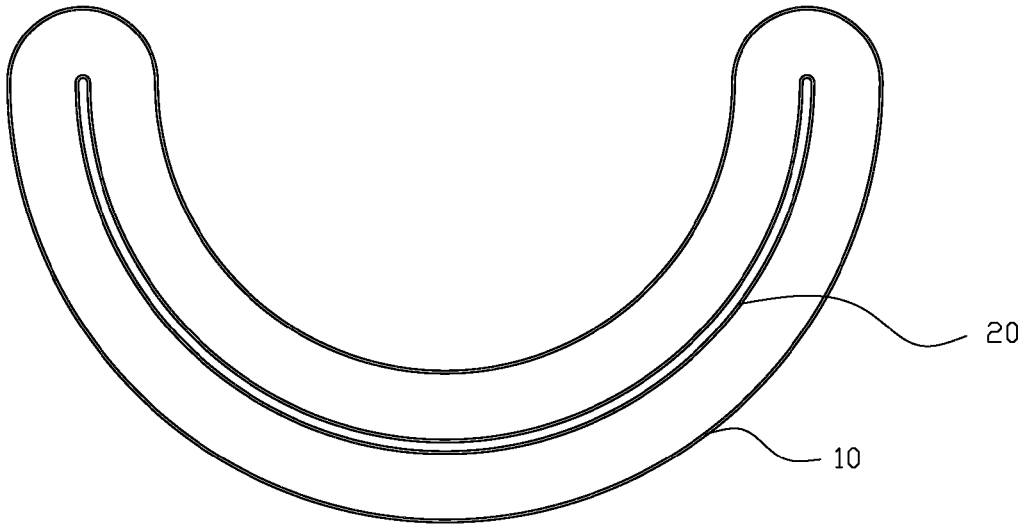
FIG. 2 is a front view showing the lower thread bobbin for a sewing machine according to the present invention.
Figure 3:
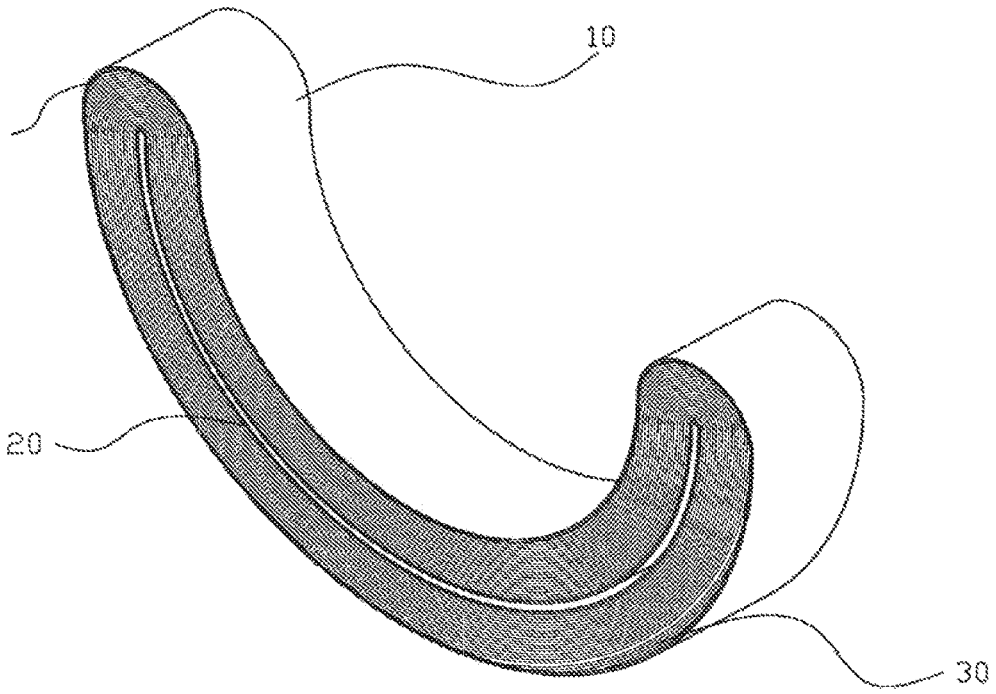
FIG. 3 is a perspective view showing the use state of the lower thread bobbin for a sewing machine according to the present invention.
Figure 4:
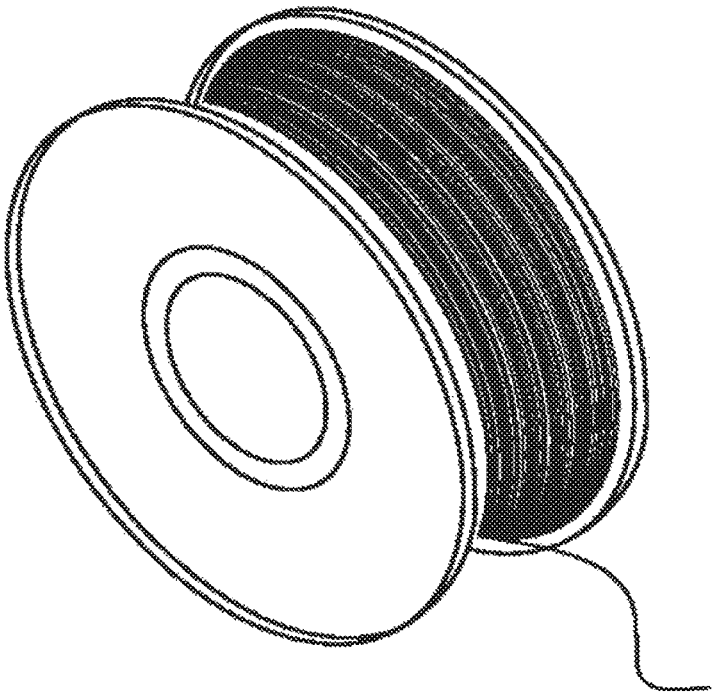
FIG. 4 is a perspective view showing the use state of a conventional lower thread bobbin for a sewing machine.

FIG. 1 is a perspective view showing a lower thread bobbin for a sewing machine according to the present invention, FIG. 2 is a front view showing the lower thread bobbin for a sewing machine according to the present invention, FIG. 3 is a perspective view showing the use state of the lower thread bobbin for a sewing machine according to the present invention, and FIG. 4 is a perspective view showing the use state of a conventional lower thread bobbin for a sewing machine.

According to the present invention, as shown in FIGS. 1 to 3, there is provided a lower thread bobbin for a sewing machine capable of holding a thread thereinto, and the bobbin includes a crescent moon-shaped winding part 20 for winding thread thereon and a crescent moon-shaped securing part 10 for covering the winding part 20 on which the thread has been wound.

As the winding part 20 and the securing part 10 have the shape of the crescent moon, the area on which the thread is wound can be increased and at the same time the thread wound on the winding part 20 can be easily unwound.

Further, the winding part 20 and the securing part 10 are made of a metal material.

In more detail, the winding part 20 and the securing part 10 are made of a steel plate.

If the winding part 20 and the securing part 10 are made of the steel plate, a greater amount of the thread can be rigidly held and fixed, and they can be easily made to have the shape of the crescent moon. In this case, further, the manufacturing cost of the lower thread bobbin according to the present invention is lower than that of general conventional lower thread bobbin.

For example, the thread of 50 m is wound on the conventional bobbin as shown in FIG. 4. However, the thread of 250-350 m can be wound on the lower thread bobbin according to the present invention.

Further, the lower thread bobbin for a sewing machine according to the present invention is capable of increasing the efficiency of sewing work as the user or sewing machinist does not exchange the bobbin frequently.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A lower thread bobbin for a sewing machine capable of holding a thread, the lower thread bobbin comprising:

a crescent moon-shaped winding part for winding the thread thereon, wherein the crescent moon-shaped winding part include a flat strip of material; and a crescent moon-shaped securing part for covering the winding part on which the thread has been wound.

2. The lower thread bobbin for a sewing machine according to claim 1, wherein the winding part and the securing part are made of a metal material.

3. The lower thread bobbin for a sewing machine according to claim 1, wherein the securing part include another flat strip of material.

* * * * *